US007814593B2

(12) United States Patent
Attila

(10) Patent No.: US 7,814,593 B2
(45) Date of Patent: Oct. 19, 2010

(54) GRADIENT BED

(76) Inventor: Mady Attila, 1450 S. Kihei Rd., Suite G104, Kihei, HI (US) 96753

( * ) Notice: Subject to any disclaimer, the term of this patent is extended or adjusted under 35 U.S.C. 154(b) by 0 days.

(21) Appl. No.: 11/868,243

(22) Filed: Oct. 5, 2007

(65) Prior Publication Data

US 2009/0089934 A1 Apr. 9, 2009

(51) Int. Cl.
*A47C 27/10* (2006.01)

(52) U.S. Cl. ..... 5/710; 5/713

(58) Field of Classification Search ..... 5/710–715
See application file for complete search history.

(56) References Cited

U.S. PATENT DOCUMENTS

| | | | | | |
|---|---|---|---|---|---|
| 2,046,039 | A | | 6/1936 | Schaar | |
| 2,604,641 | A | | 7/1952 | Reed | |
| 2,657,716 | A | | 11/1953 | Ford | |
| 2,703,770 | A | | 3/1955 | Melzer | |
| 2,743,510 | A | | 5/1956 | Mauney et al. | |
| 2,753,573 | A | | 7/1956 | Barker | |
| 2,872,690 | A | | 2/1959 | Neisler, Jr. et al. | |
| 3,008,213 | A | | 11/1961 | Foster et al. | |
| 3,138,506 | A | | 6/1964 | Ross | |
| 3,205,106 | A | | 9/1965 | Cross | |
| 3,674,019 | A | | 7/1972 | Grant | |
| 4,594,743 | A | * | 6/1986 | Owen et al. | 5/111 |
| 4,653,130 | A | * | 3/1987 | Senoue et al. | 5/713 |
| 4,803,744 | A | | 2/1989 | Peck et al. | |
| 4,864,671 | A | | 9/1989 | Evans | |
| 5,109,560 | A | * | 5/1992 | Uetake | 5/713 |
| 5,152,018 | A | | 10/1992 | Lea | |
| 5,163,196 | A | * | 11/1992 | Graebe et al. | 5/654 |
| 5,243,723 | A | | 9/1993 | Cotner et al. | |
| 5,367,728 | A | * | 11/1994 | Chang | 5/689 |
| 5,483,709 | A | | 1/1996 | Foster et al. | |
| 5,564,142 | A | | 10/1996 | Liu | |
| 5,598,593 | A | | 2/1997 | Wolfe | |
| 5,915,819 | A | * | 6/1999 | Gooding | 36/29 |
| 5,926,884 | A | * | 7/1999 | Biggie et al. | 5/714 |
| 5,960,495 | A | | 10/1999 | Hsu et al. | |
| 5,983,428 | A | | 11/1999 | Hannagan | |
| 6,134,732 | A | | 10/2000 | Chapman et al. | |
| 6,148,461 | A | * | 11/2000 | Cook et al. | 5/713 |
| 6,216,300 | B1 | | 4/2001 | Hannagan | |
| 6,546,580 | B2 | | 4/2003 | Shimada | |
| 6,671,910 | B2 | | 1/2004 | Hsu et al. | |
| 6,701,559 | B2 | * | 3/2004 | Boso et al. | 5/739 |
| 6,973,690 | B2 | | 12/2005 | Muci et al. | |
| 2004/0226101 | A1 | * | 11/2004 | Lin et al. | 5/710 |
| 2008/0109964 | A1 | * | 5/2008 | Flocard et al. | 5/713 |

* cited by examiner

*Primary Examiner*—Peter M Cuomo
*Assistant Examiner*—Nicholas Polito

(57) ABSTRACT

A three dimensional matrix of air, other gas, or hydraulic fluid cells is proposed for the purpose of providing an ideal surface for load distribution. These cells will be arranged into layers stacked onto each other, with successive layers inflated to decreasing pressures. Neighboring cells can either communicate with each other freely, emulating an open cell construction, or be locked, emulating a closed cell construction, thus providing dynamic, as well as passive, control.

1 Claim, 7 Drawing Sheets

GRADIENT BED

BACKGROUND OF THE INVENTION

Technical Field

Sleep, beds, health, personal hygiene.

LEXICON

Definitions

Mattress is defined as the complete apparatus

Mattress stratum (layer) is defined as one integral component of this construct defining an individual air containment unit Mattress containment is defined as the apparatus to contain and house the strata that together comprise the supportive substance of the mattress Mattress control include those mechanical, electronic and manual fittings that contribute to regulation of pressure distribution within the mattress.

Non-communicating is defined as the absence of a connection permitting exchange of contents. For example, two strata may share a substantial surface contact area, yet not be in communication.

"Air cells" are air, fluid, or other gas-filled spaces that are distinctly partitioned from within the volume of the rest of the stratum. Neighboring "cells" may communicate with each other, but are nevertheless more or less completely defined by an enclosure that is spherically complete (though not necessarily spherical in shape).

For the purposes of easy orientation a Cartesian (orthogonal) coordinate system shall be used to define the mattress:

X) X axes are defined as any axes parallel to the longest orthogonal axis of the mattress (the "length").

Y) Y axes are defined as any axes parallel to the width of the mattress.

Z) Z axes are defined as any axes parallel to the height of the mattress.

BACKGROUND OF THE INVENTION

People need sleep. Many people can't sleep. Mattress manufacturers and sales entities purport to remedy these matters through various items of mattress technology.

Beds are used in private or institutional settings. Current mattresses are unwieldy, unhygienic, expensive and of insufficient durability. Air mattresses were designed to remedy some of these shortcomings. However, air mattresses themselves suffer from multiple deficiencies, including unwieldiness, cost (for the higher end products), fragility and lack of comfort.

Lack of comfort is central to the failure of air mattresses to take over the market. Air mattresses are far more flexible in their use than ordinary mattresses. They can be deflated and stored with minimal space requirements. They are light and easy to transport. They are silent. They are also more hygienic (though still suffering from deficiencies in this area, such as the lack of air movement and thus the build-up of transpiration and other human excretions at the surface of the air bladder).

But standard air mattresses are still woefully inadequate because they are essentially no more than a dressed up air bladder. Some improvement have been proposed in prior art, but little of this promising technology has been translated into the market.

Air beds bottom out, they do not provide the same support as current mattresses, they are subject to imbalance and uncomfortable deformation when the load is presented and they cannot achieve the same height profile expected of a standard bed.

The proposed technology will remedy all air bed (and other air mattress support applications) shortcomings. In various embodiments it will permit the perfect emulation of the characteristics of most currently marketed bed. It will be able to transmit air to the surface, useful for hospital applications. And its ease of manufacture means that its cost should not be significantly higher than that of current air beds.

For institutional use, the issue of paramount importance is skin integrity and prevention of decubitus ulcers. For a detailed discussion refer to Zdravko (EP1037582). A brief excerpt is EXTENSIVELY PARAPHRASED here:

"Maximum permissible pressure to prevent hindering the circulation of blood—and therefore to prevent decubiti—is equal to the mean pressure in the arterial capillaries. This is estimated as approximately 4 kPa (30 mm Hg=40.8 g/cm2). Some other authors (K. D. Neander) recommend the upper limit to be reduced below the mean pressure in venal capillaries, 1.6 kPa (12 mm Hg=16.5 g/cm2) in any region that constitutes primary support to the body. further, measurements made by Khan, K. Lee and their associates indicate that the pressure at the supporting region is increased by 3 till 5 times if any of the prominent bones occurs within the region. The importance of this issue is well known in medicine; the parts of the body lacking fat tissues under the skin are critical in forming the decubitus (FIG. 2.7). External pressure, according to fluid mechanics. should therefore be reduced to 3 to 5 times less than 1.6 kPa to allow an undisturbed blood circulation in this critical regions.

In contrast to this pressure maximum, pressures when laying on a hard surface can, at the critical points, reach a magnitude of 40 kPa (300 mm Hg=408 g/cm2). Sitting is even more dramatic, 666 kPa (5000 mm Hg=6.8 kg/cm2) (E. R. Tichauer) (FIGS. 2.3 and 2.4). Well designed mattresses will dramatically reduce these high pressures, to below the pressure in the venous capillaries. However, the pressure under 1.6 kPa can be obtained only if the body is distributed horizontally and without significantly elevated sections."

BACKGROUND ART (All prior art is provided primarily for background purposes. There is no directly applicable prior art to reflect the function, structure and purpose of the currently proposed technology.)

U.S. Pat. No. 4,193,419 describes a sequence of tubes arranged in layers and stacked vertically. There is no mention of a gradient pressure arrangement. The tubes are not divided into individual cells. Input and output from the cells cannot be regulated.

U.S. Pat. No. 6,546,580 prescribes a three-layered mattress assembly that is permanently inflated. As specified in the claims, the three layers are formed by three separate plastic lamina secured to each other in a very specific pattern (see claims). The bottom layer only is inflated to a higher pressure than the upper two layers (there is no specification whether these upper two layers might be inflated to different pressures from each other). Aside from the obvious deficits as compared to the currently proposed technology, one major problem is the issue of weight and amount of material required.

The modular and tubular model proposed by the current application distributes the load to many independent components, resulting in minimal loads on each. Cell wall thickness remains at a minimum even in the case of the heaviest envisioned load, reducing mattress weight and material requirements. Also, three layers are not sufficient to distribute the load in such a fashion as to make the mattress feel "luxurious", comparable to a mattress of solid construction. Additionally, the proposed mattress cannot percolate air to the skin, if so desired. Finally, the proposed mattress cannot be manufactured in a modular fashion, thus reducing cost, if so desired.

The above are the same problems shared by multiple other patents, such as U.S. Pat. Nos. 2,046,039, 2,604,641, 2,657,716, 2,753,573, 2,872,690, 3,008,213, 3,138,506, 3,205,106 & 5,152,018).

The multiple single or double layer anti-decubitus (U.S. Pat. Nos. 3,674,019, 4,803,744, 4,864,671, 5,243,723, 5,483,709, 5,598,593, 5,5641,42, 5,960,495, 6,148,461 & 6,134,732) all focus on some means of selectively rotating deflated cells. None achieve the manner of weight distribution of the gradient bed, as they cannot be classified as multi-layer (even the two layer embodiments are only single layer at least part of the time due to deflation of individual cells).

GB2197192 describes a useful concept intended as a supplementary mattress for institutional use. It prescribes control of each individual cell through a complex concentric differential pressure mechanism. It would be expensive and impractical for home use. It also requires active control technology to achieve. The currently proposed technology achieves gradient distribution of pressure primarily through passive and inexpensive means.

GB2197192 is single-layer technology (multiple pressure zones are integrated for control, but weight is supported by a single layer of triple-gusseted air cells). GB2197192 does not propose containment within a standard mattress architecture. The cells are exposed. Primary function is not sleeping comfort, but patient positioning.

U.S. Pat. No. 5,243,723 talks about multi-layer and multi cell architecture for anti-decubitus purposes. Aside from the fact that this is not the intent of the present patent, U.S. Pat. No. 5,243,723 specifically talks about individual cell inflation, which is not required for the present patent. It specifically talks about two pairs of layers, layers within each pair inflated to identical pressures. The present application specifically recommends multiple layers with progressively decreasing pressures and, rather than pressure variation within individual zones, a pressure profile across the layers that is subject to control. Further, U.S. Pat. No. 5,243,723 does not prescribe any puncture resistance or open vs. closed cell control.

No other relevant prior art has been found, USPTO or worldwide.

BRIEF SUMMARY OF THE INVENTION

A three dimensional matrix of air, other gas, or hydraulic fluid cells is proposed for the purpose of providing an ideal surface for load distribution. These cells will be arranged into tubes separated by septae impermeable to air. These tubes are lined up parallel to form layers (strata); strata are stacked onto each other. Successive layers are inflated to decreasing pressures. Neighboring cells can either communicate with each other freely, emulating an open cell construction, or be locked, emulating a closed cell construction, thus providing dynamic, as well as passive, control.

DETAILED DESCRIPTION OF THE INVENTION

Figure 1:
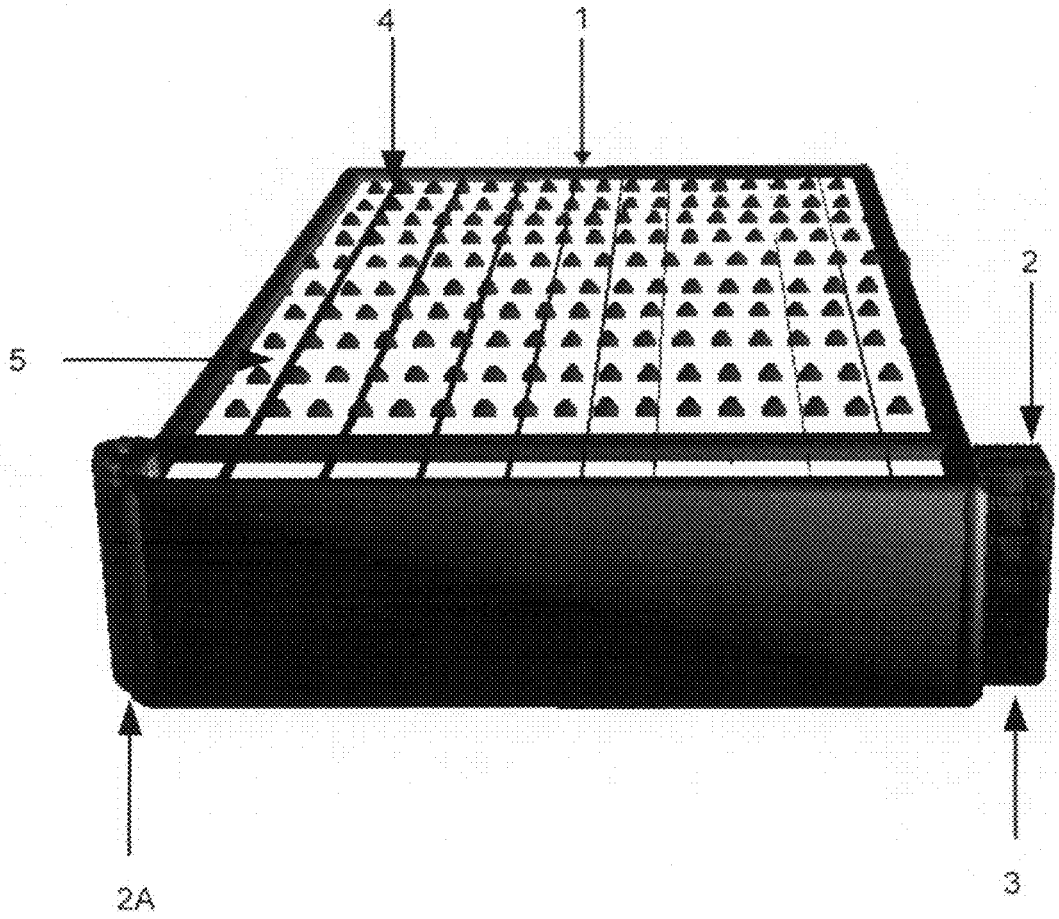
FIG. 1 (3D rendered frontal oblique view) illustrates one embodiment of a complete assembly in its entirety. Note that the frame (1) surrounding the assembly is also inflatable. Additional items are Pressure Regulation Blocks (2 and 2A), Primary Intake/lowest level (3), Septae (4) and Individual Air Cell (5).
Figure 2:
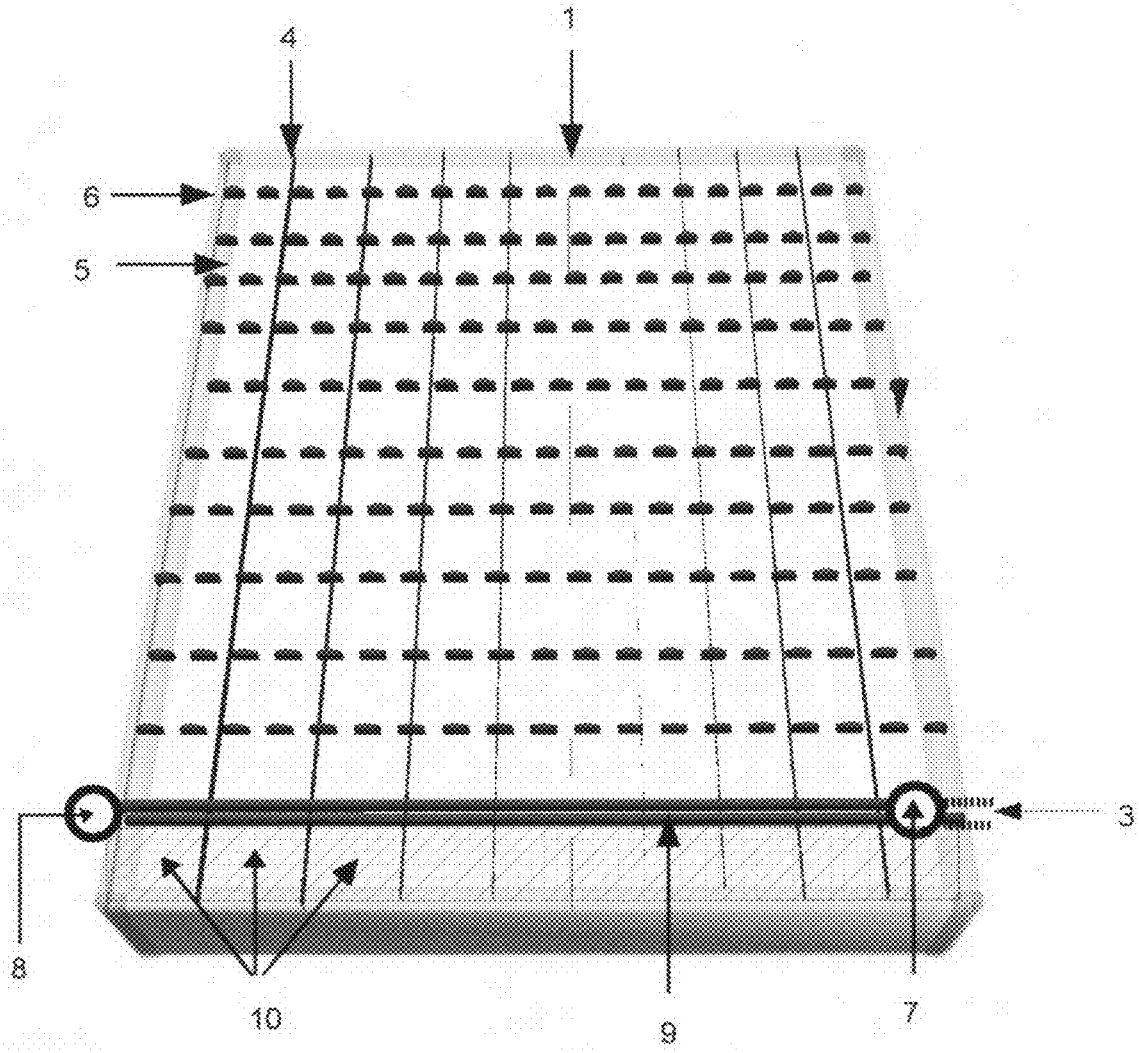
FIG. 2 (3D rendered frontal oblique view) shows the bottom stratum. Additional items are Air Cell Wall (6), Mattress Inflation Valve (7) and Regulator Valve (8), Inflation Reservoir Wall (9), Inflation Cells (10).
Figure 3:
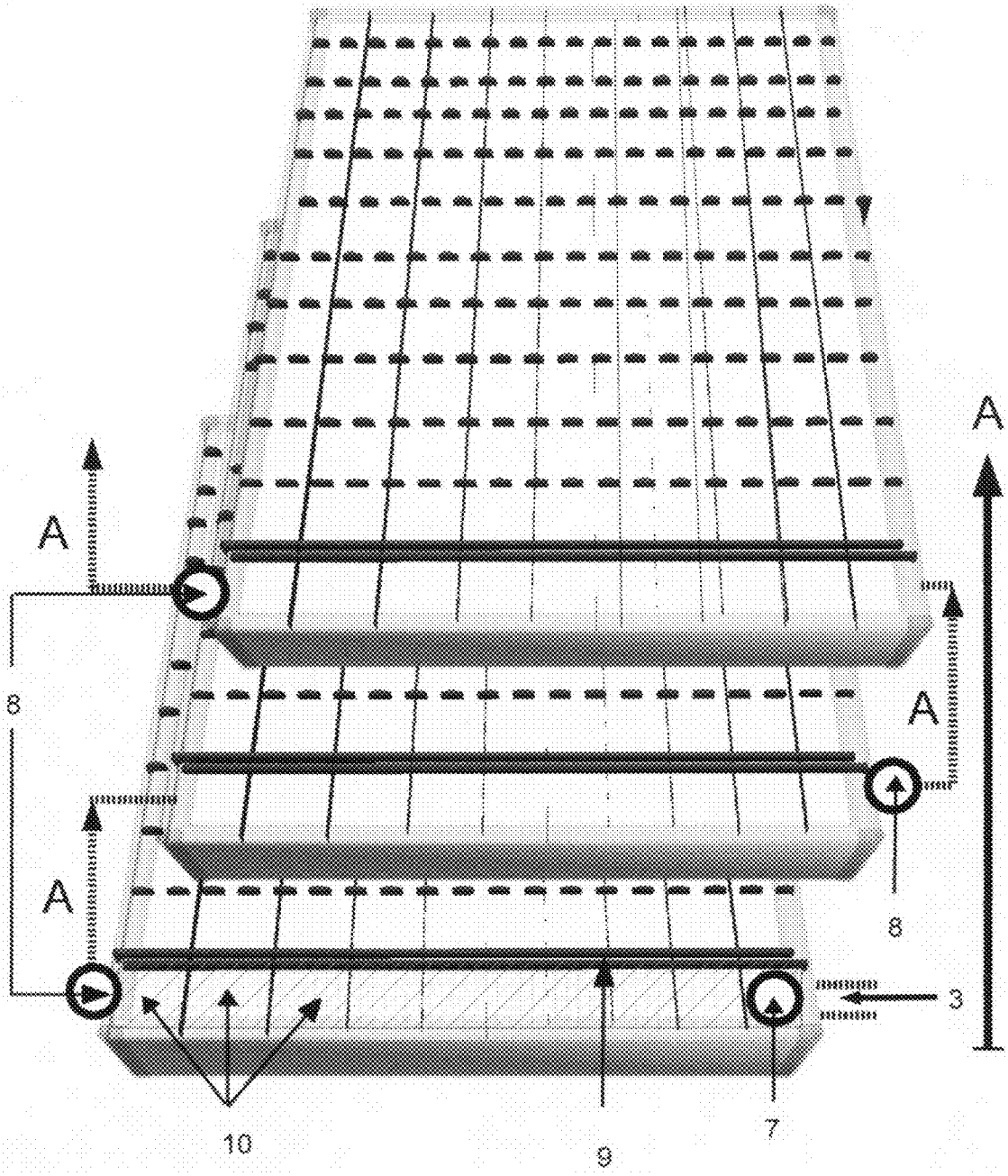
FIG. 3 (3D rendered frontal oblique view) demonstrates how strata are stacked. It also illustrates the inflation sequence. Additional items are Inflation Order (Solid and Stippled Arrows A).
Figure 4:
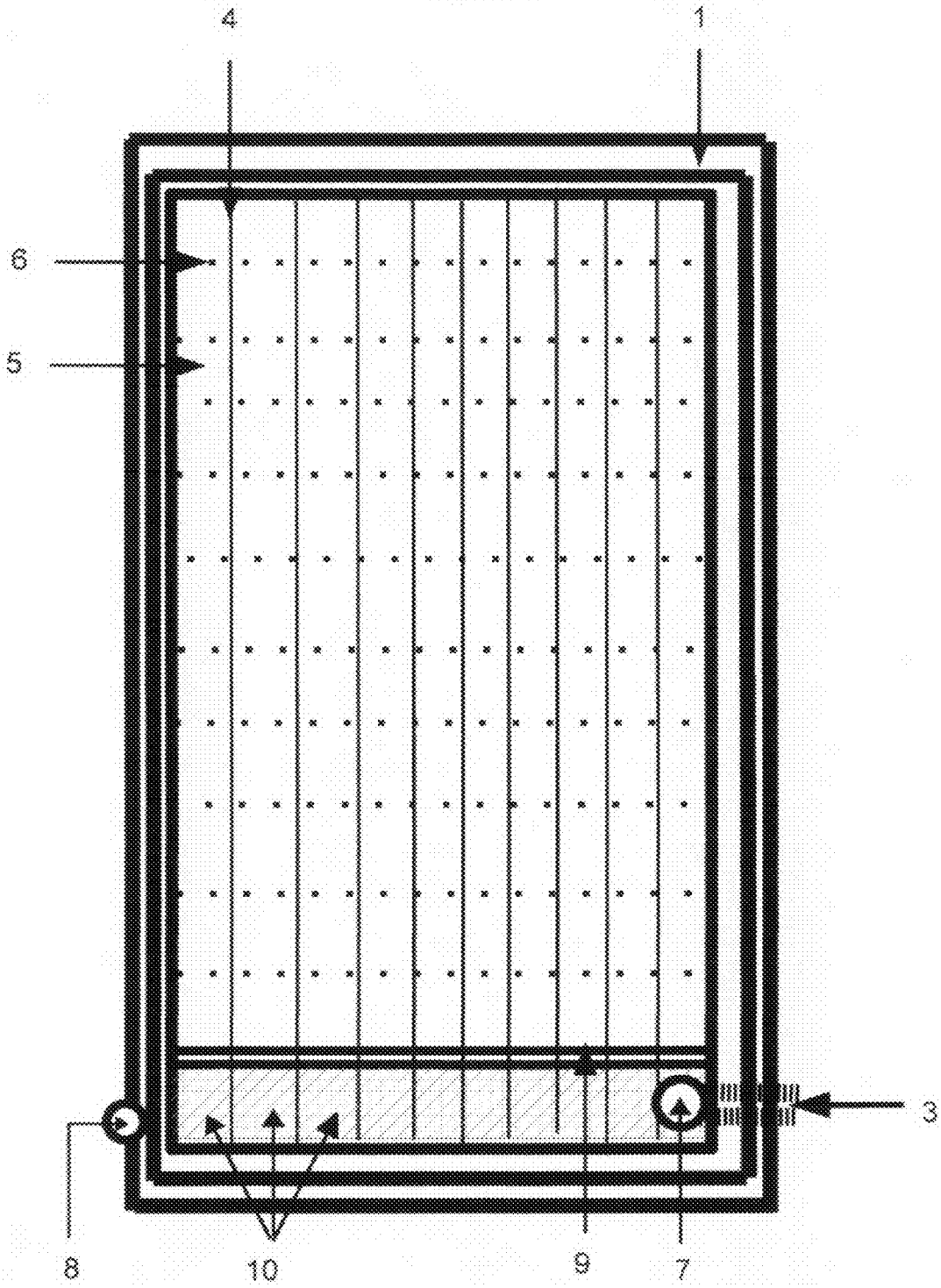
FIG. 4 (top view) shows a single stratum, including the frame.
Figure 5:
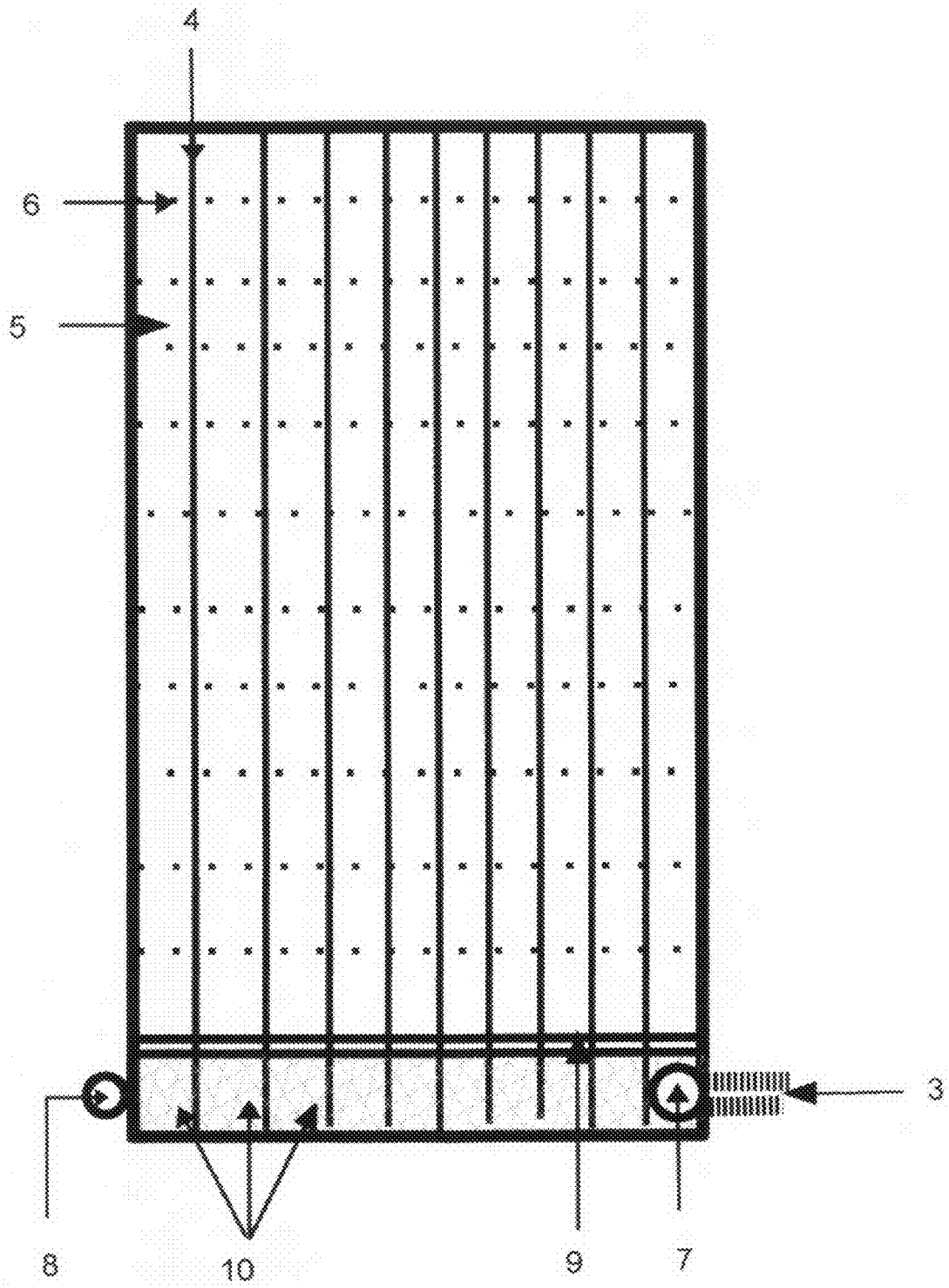
FIG. 5 (top view) shows a single stratum without the frame.
Figure 6:
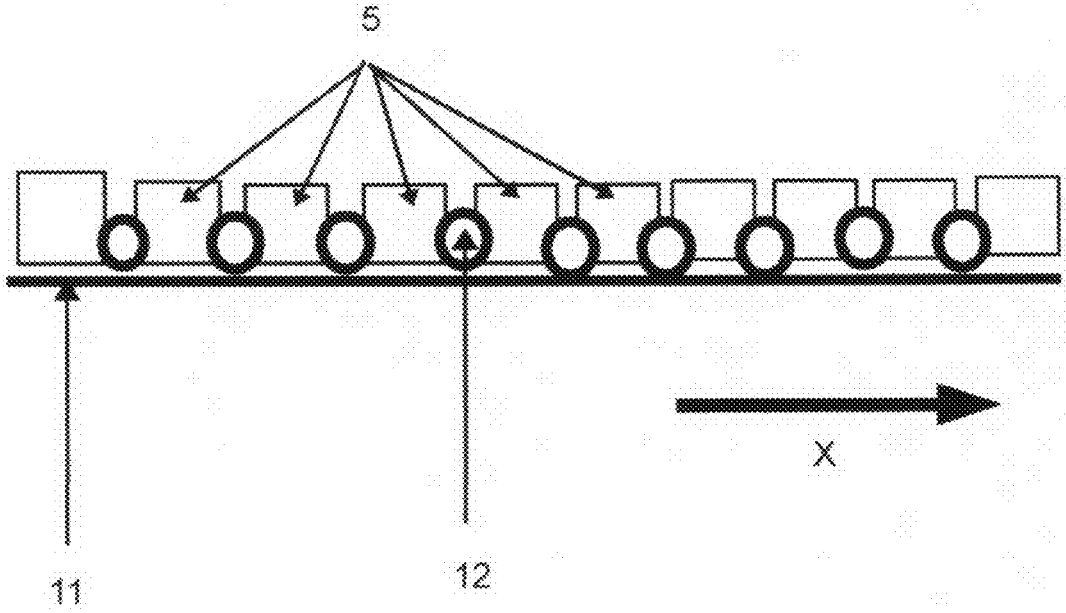
FIG. 6 (longitudinal side view in cross section) shows a row of cells in cross section. The optional control lines (12) (i.e.: for determining whether individual cells communicate with each other) are shown and emphasized. Additional items are Basement Membrane (11) and Long Axis (X).
Figure 7:
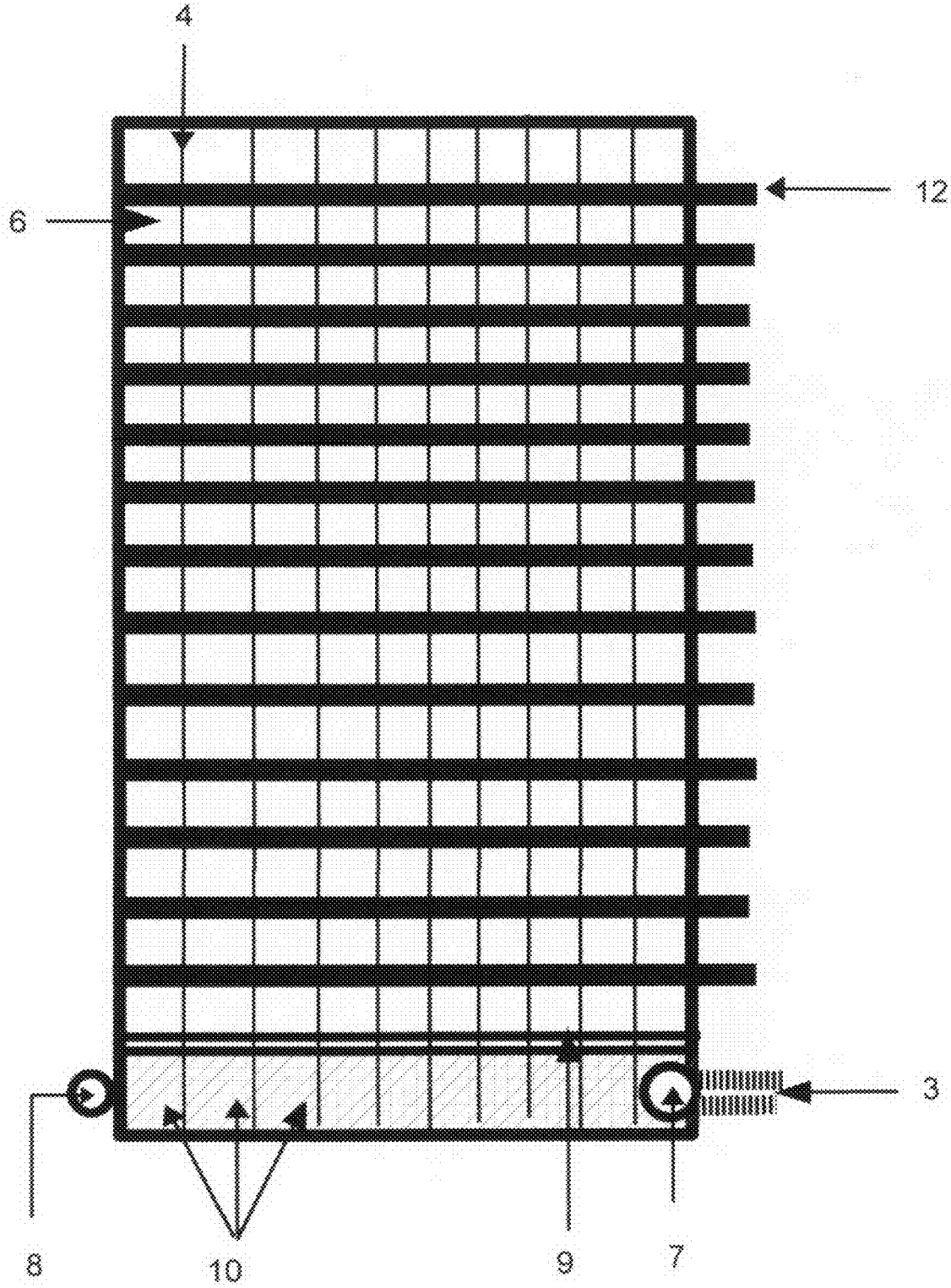
FIG. 7 (top view) shows a single stratum without the frame. The optional control lines are emphasized.

A number of strata are constructed and stacked together vertically. Neighboring strata are laminated to each other along their top and bottom layers to achieve a secure construct. This assembly in turn is enveloped by an external containment mechanism.

The strata are constructed in a precise manner. They are composed of parallel rows of air cells that communicate with a common air or fluid reservoir at each end. The rows themselves are independent of each other and do not communicate with each other at any point. Neighboring cells can be shaped so as to touch each other when completely inflated, to completely define the space outlined by the stratum (i.e.: to "fill" all the space) or to be distinct from neighboring cells.

These cells will be joined to neighboring cells along the row in such a manner as to permit the transit of air between cells. However, it is also possible to lead pressure channels from the highest pressure chamber to the openings leading from one cell to the other. Inflation of these pressure channels would result in kinking of the neck of the communication tunnel and thus close the cell. This would provide dynamic control, altering the behavior of the apparatus while the load is first placed, or if it is shifted.

The assembly is inflated through a master reservoir attached to the lowest layer. Overflow from this reservoir regulated to a specific pressure through a one way valve would be conducted into the next lowest layer. Overflow from that layer would be conducted into the next lowest layer, and so on.

To preserve puncture resistance, each individual row might be served by its own pressure reservoir and exhaust valve. Rows within an individual layer would be calibrated to have identical pressure.

Automatic means might be provided to regulate the pressure of each row individually. In such a case it would be possible to regulate the profile of the bed very precisely, but this would add to cost.

The successive layers will be laminated to each other either with intermediary membranes permeable to air, or directly. In either case, a contiguous potential volume will be defined within the matrix of the mattress that will be contained outside of the air cells. Air could be percolated through this space and to a permeable outer envelope, thus solving the breathability problem of air mattresses.

The shape of the entire air mattress assembly would be amenable to precise control through the use of hydraulic channels laminated into the outside envelope ("turgor shaping"—technology described in a separate and concurrent application). These hydraulic channels would be integrated into the outer envelope and primed with either air, another gas, or a fluid at a high pressure to provide absolute rigidity emulating a solid construction.

Baffles might be inserted into the mattress to utilize this same turgor principle and increase the structural integrity of the assembly without compromising flexibility.

Contact sensors inserted into individual air cells would be able to reveal inadequate load support and would permit automatic regulation of pressure, pressure profile (and even dynamic characteristics, as described above regarding opening versus closing the communication channels between neighboring cells).

Since individual air cells would experience small loads, wall thickness would thus be nominal (think of bubble wrap). While there would be more total membrane surface used in the construction, the decrease in wall thickness would more than compensate in terms of maintaining—and possibly even reducing—overall weight.

It is envisioned that 10 to 12 layers would achieve the desired function. More or less may be necessary.

The proposed mattress is unique in that it will not bottom out. It can therefore be made to be of a much lower profile than current mattresses, as thin as 15 cm. This may be desirable for the purpose of compactness and portability. It is not an absolute requirement.

Except puncture of the master pressure containers on the ends, this mattress could be made effectively puncture proof. The use of individual reservoirs for each row would mean that that damage to an air cell or a number of air cells would result in the loss of only single rows, not layers. A large number of rows could be lost without loss in mattress performance.

All improvements noted are achieved through inexpensive structural changes. The number of components is increased somewhat, but no new materials or fittings are required. No new material properties are required, nor is there a significant increase in the amount of raw materials required. Realizing these changes is a challenge of trivial difficulty and can be achieved through alterations in the manufacturing process.

In the preferred embodiment the sleeping surface will be a natural fiber product secured onto the surface of a gas-permeable liquid barrier such as GORETEX® ((tetrafluoroethylene homopolymer).

Low weight, construction material requirements, construction complexity and the possibility to produce in a modular fashion permit mattresses of extraordinary dimensions without significant increase in cost.

The above mattress assembly can be applied to an inflatable base of analogous layered construction, but without any of the added improvements such as gradient pressures. This would provide elevation to the mattress to emulate a current conventional mattress arrangement, retain the secure characteristics of the current technology, but without undue increase in cost of manufacture.

Just as some people prefer hard mattresses, some also prefer more non-yielding ones (mattresses that do not adapt or yield quickly to the load presented to them, or to a shifting load). For a foam mattress this can be achieved with a closed cell construction, as opposed to open cell. For the gradient technology this can be achieved through the use of high pressure lines that lead back horizontally and in a transverse orientation across the long axis of the longitudinal tubes (i.e.: along the Y axis) in such a manner as to span the restrictive and regulatory conduits linking individual air cells. Inflation of these high pressure conduits can be used to compress these communicating conduits to impede air movement, and thus equilibration of pressure of the neighboring air cells. Compression of these communicating channels would convert the default open cell architecture into a closed cell one. This in turn would change the dynamic characteristics ("feel") of the mattress under load presentation and load shift. This feature would add only minimally to the complexity, and thus cost, of the assembly.

This last feature is applicable to other architectures not specifically covered by the claims of this patent application.

The invention claimed is:

1. An inflatable mattress comprising:

an outside envelope, comprising:

a number of strata constructed and stacked together vertically, wherein each stratum is laminated to an intermediary membrane permeable to air along a top surface of the stratum and a bottom surface of the stratum each stratum in fluid communication with a common fluid reservoir either at a front side of the mattress, or a back side of the mattress, and wherein each stratum of the mattress is inflated to successively decreasing pressure from the bottom stratum to the top stratum, each stratum comprising:

longitudinal parallel rows of air cells, each air cell of each row comprising regulatory conduits linking each air cell in fluid communication, and transverse high pressure channels spanning a top surface of the regulatory conduits between each cell, the transverse high pressure channels operable to compress the regulatory conduits to impede fluid communication, and contact sensors inserted into one or more air cells operable to reveal inadequate load support, and:

a pressure reservoir, a master reservoir attached to the lowest stratum, a one way valve attached to each pressure reservoir operable to vent overflow pressure to the stratum above.

* * * * *